United States Patent [19]

Hennecke et al.

[11] Patent Number: 4,483,403

[45] Date of Patent: Nov. 20, 1984

[54] SHAFT DRILLING MACHINE

[75] Inventors: Johannes Hennecke, Mulheim-Uhlenhorst; Heinz Horst, Duisburg; Helmut Podellek, Kamp-Lintfort, all of Fed. Rep. of Germany

[73] Assignee: Mannesmann Aktiengesellschaft, Dusseldorf, Fed. Rep. of Germany

[21] Appl. No.: 375,038

[22] Filed: May 5, 1982

[30] Foreign Application Priority Data

Mar. 17, 1982 [DE] Fed. Rep. of Germany ..... 3209611

[51] Int. Cl.[3] ..... E21D 1/06

[52] U.S. Cl. ..... 175/88; 299/57; 299/31; 175/102; 175/172

[58] Field of Search ..... 175/88, 98, 99, 102, 175/172, 396; 299/56, 57, 31

[56] References Cited

U.S. PATENT DOCUMENTS

| | | | |
|---|---|---|---|
| 2,202,584 | 5/1940 | Holmes | 299/57 |
| 3,309,142 | 3/1967 | Winberg | 299/33 |
| 3,379,264 | 4/1968 | Cox | 175/102 |
| 3,475,055 | 10/1969 | Snedden | 299/56 |
| 3,486,794 | 12/1969 | Tabor | 299/56 |
| 3,672,726 | 6/1972 | House | 299/31 |
| 3,965,995 | 6/1976 | Sugden | 175/88 |

*Primary Examiner*—Stephen J. Novosad
*Assistant Examiner*—William P. Neuder
*Attorney, Agent, or Firm*—Mandeville and Schweitzer

[57] ABSTRACT

A shaft drilling machine has a circularly moving drilling head. The drilling head is angularly oriented with respect to the longitudinal axis of the shaft sought to be drilled. Loosened material is transported from the lower portion of the shaft by pickup means, moving with the drilling head, and taken to the upper portion of the angularly oriented bottom of the shaft, whereupon the loosened material or borings slide, by gravity, to a centrally located vertical conveyor mechanism for final removal of the material or borings from the shaft.

5 Claims, 2 Drawing Figures

SHAFT DRILLING MACHINE

BACKGROUND OF THE INVENTION

The present invention relates to a full-cutting shaft drilling machine for sinking or drilling shafts into the earth. Such a machine comprises a frame which may be braced in the as-drilled shaft, and a rotatively driven drilling head which is movable in the direction of the shaft. A conveyor apparatus for removing the borings is provided with the drilling head.

DESCRIPTION OF THE PRIOR ART

It has been known, for more than ten years, in the shaft building and drilling technology, particularly for the sinking or drilling of blind opening shafts and, in addition, for deepening existing open-cast shafts, to use shaft drilling machines with which it was always a problem to remove the large heaps of debris, i.e., the loosened material. The most commonly used mechanisms were shaft drilling machines which removed the bored debris through an advance bore hole passing into the center of the shaft. This, however, presupposed that the shaft, intended to be drilled, had been first undercut, prior to the start of the drilling process. The cost for an advance borehole is, of course, part of the total price for the drilling of the new shaft. The economies of drilling thus poses the problem of drilling shafts without first drilling advance boreholes.

Full-cutting shaft drilling machines of the initially described type have been provided with a drilling head which is closed in its center and works in drilling mud which is located at the bottom of the shaft. The drilling mud is used for removing the hydraulically conveyed borings, i.e., the loosened material. This system, however, cannot be employed in ravines because of loss of drilling mud due to drying-out of the mud at the bottom of the shaft. Nor can the mud be used to work in frozen of freezing shafts. Beyond that, mountain drainage requires expensive technology and a relative high energy consumption.

In another known shaft drilling mechanism, the borings or loosened materials are conveyed by a scraper-type conveyor, to a small bucket conveyor. The scraper conveyor directs the borings to the bottom of the shaft, where they are picked up and brought into the area of a bucket conveyor installation, from where the borings are conveyed in the buckets to the top of the shaft. In this process, the bottom of the shaft is not sufficiently cleaned which results in the drilling tools not being able to properly and efficiently work. A corresponding amount of energy and wear and tear will thus result. The same, of course, holds true for scraper conveyors. Both solutions are particularly disadvantageous because the ease and efficiency of removability of the mined materials or borings directly affects the efficiency of the shaft-drilling machine.

SUMMARY OF THE INVENTION

The object of the present invention is to provide a full-cutting shaft drilling mechanism which accomplishes picking up and transferring of the borings or mined materials, with minimal building expenditure and a high drilling capacity. A conveyor apparatus which is simple and workable is thus provided.

To solve the problems of the prior art, it is now proposed that the rotational axis of the drilling head be angularly arranged, i.e., at an incline to the vertical axis of the shaft being drilled. The drilling head is provided, at its outer circumference, with pickup scoops which skim over the bottom of the shaft and collect the loosened materials or borings. The scoops are arranged such that the borings may be transported, as the drilling head moves, by means of the pickup scoops, from the lowest point of the shaft bottom into the pickup area of a vertical conveyor apparatus which reaches into the center of the drilling head.

By inclining the drilling head, according to the invention, in relation to the longitudinal axis of the shaft, the shaft bottom is caused to be in a relatively sloping position and it is possible, with the aid of the pickup scoops at the drilling head, to transport the borings in the scoops, as the drilling head moves, to the top portion of the inclined bottom of the shaft, where the borings glide, by the force of gravity, into a receiving area of a vertical conveyor apparatus.

The rotational axis of the drilling head, in the preferred embodiment of the invention, forms an angle with the longitudinal axis of the shaft, of between about 35° and 50°. The tools working on the bottom of the shaft are arranged in a substantially single plane. This creates a smooth shaft bottom, with a downwardly sloping gradient angle which assures that the now-loosened borings self-activate themselves into gliding into the lower portion of the bored shaft, whereupon the borings are picked up by means of the pickup scoops and transported to the upper portion of the shaft floor. From there, the borings, again by gravity, slide downwardly to a receiving area of a vertical conveying apparatus.

It is true that operation of the present invention results in an elliptically shaft cross section because the drilling head, operating in a circular manner, is arranged at an incline to the vertical shaft axis. However, the elliptical cross section may be better made use of, in most cases, particularly when the main axis of the ellipse extends in the direction of the strongest rock formation. Elliptical cross sections are also more usable in conveyor shafts because it is there that two adjacently arranged conveyor vessels, e.g., elevators, must be arranged to conserve space.

Yet another characteristic of the present invention is that the vertical conveyor installation operates hydraulically or pneumatically and cooperates with a chute which is stationarily arranged with respect to the machine frame or the drilling head. The conveyor mechanism has its intake opening reaching into the area of the drilling head beneath the respective discharge opening of the pickup scoops. The hydraulic or pneumatic conveyor apparatus, known per se, eliminates work on the otherwise present drilling mud. The borings conveyor capacity is correspondingly high because the borings are mechanically conveyed in the critical area of the shaft bottom and are, thereby, almost completely removed without the need of additional scraping conveyors or other devices.

Yet another characteristic of the present invention is that the vertical conveyor apparatus can be a bucket conveyor which reaches into a central stationary chamber of the hollow drilling head. The hollow drilling head moves around the central chamber during drilling. The chamber is connected to the discharge openings of the pickup scoops when they reach the upper level of the shaft bottom. The use of mechanical conveyor installations is also more effective in the present invention because the proposed bucket conveyor has maximum amounts of borings conveyed to it and, therefore, shows a high output performance in removing the borings. In sum, a high performance capacity of the shaft drilling machine is thereby achieved, caused by the fact that the previous disadvantages in the removal of the borings are eliminated due to the inclined orientation of the drilling head with respect to the longitudinal axis of the drilled shaft.

If, for whatever reason, it is desirable to make circular shaped bottom shafts, the drilling head, with its inclined rotational axis, is pivotally arranged around its vertical axis. The motor drives of the drilling head may, under certain circumstances, be capable of cooperating with this rotative motion.

An exemplary embodiment of the invention is schematically presented in the drawing and described as follows:

DETAILED DESCRIPTION OF THE INVENTION

Figure 1:
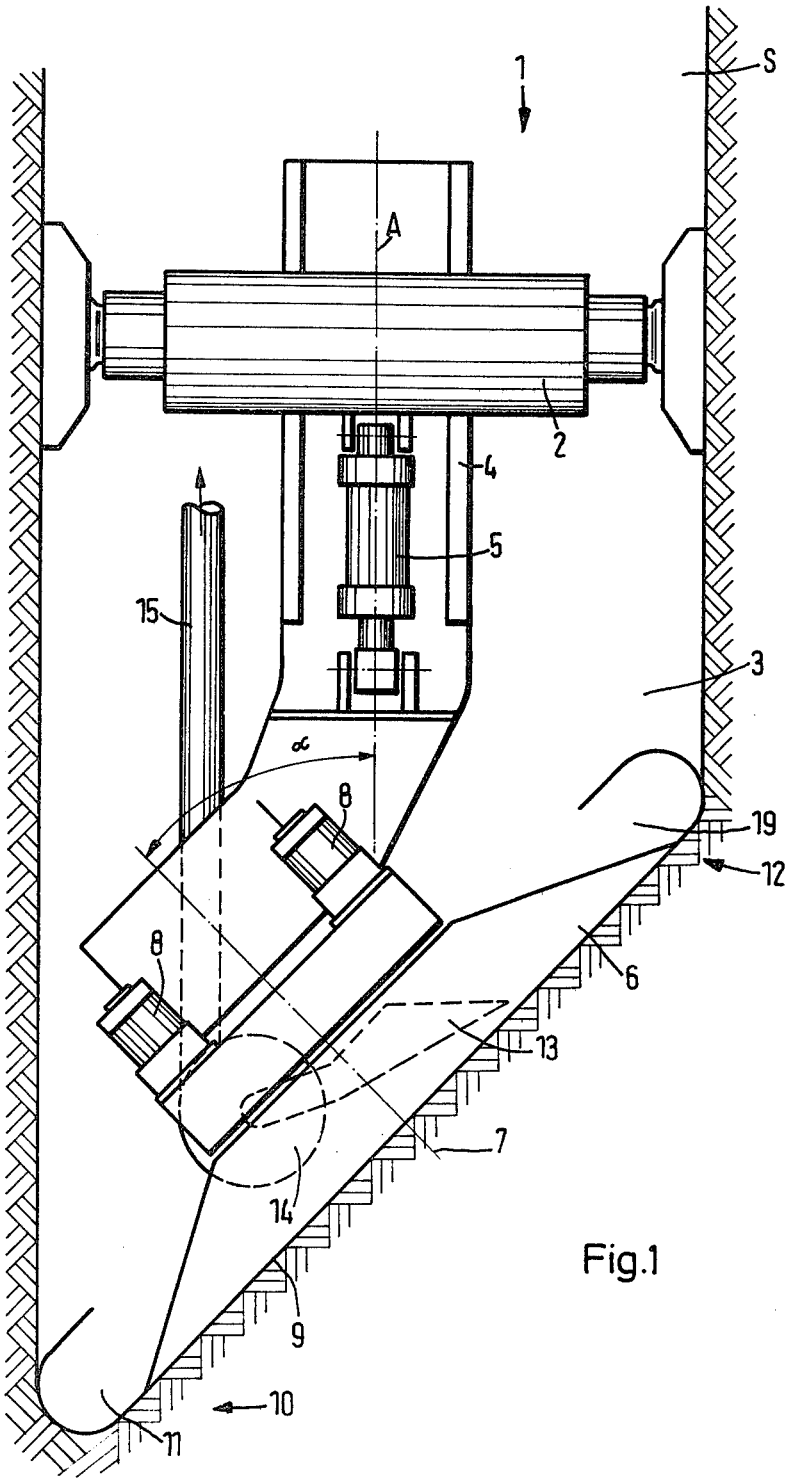
FIG. 1 shows the shaft drilling machine, according to the present invention, with pneumatic or hydraulic loose material conveyance.

The shaft in FIG. 1 is marked S, in which the full-cutting machine 1 is located for boring. The machine is braced against the side wall of the shaft by bracing mechanism 2. The frame of the machine may be adjusted, as at 4, in the direction of the shaft in relation to the bracing device 2. A driving cylinder 5 is provided to accomplish the movement of the machine 1 with respect to the brace 2.

Figure 2:
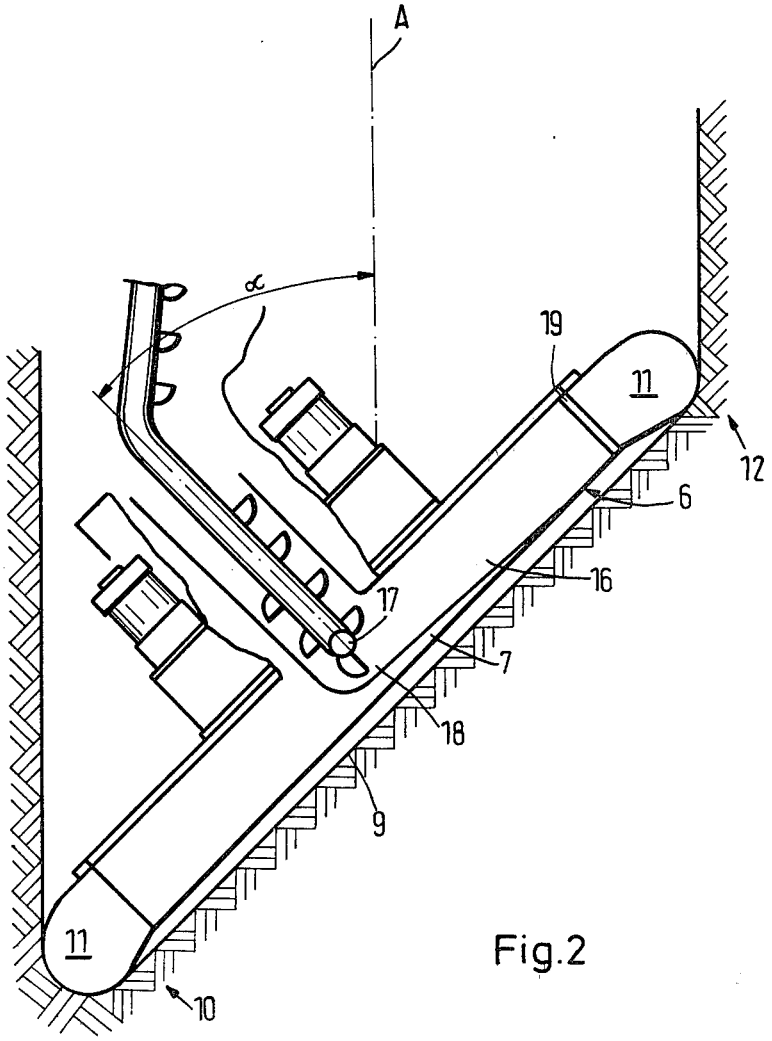
FIG. 2 shows the shaft drilling machine, according to the present invention, having a scoop-type loose material conveyor.

The drilling head 6 of the shaft drilling machine 1 is rotatively powered around the rotative axis 7 by motors 8. As seen in FIGS. 1 and 2, the rotative axis 7 of head 6 is inclined, according to the present invention, by angle $\alpha$ in relation to the longitudinal axis a of the shaft. This angular incline of the rotative axis 7 results, in the arrangement of the material loosening mining tools, not specifically illustrated, located at shaft bottom 9 also being inclined at angle $\alpha$ in relation to the longitudinal axis of the shaft. This incline of the shaft bottom 9 causes the mined borings, i.e., the loosened mined material, to slide to the lowest point of the base 10 (to the left in FIG. 1), where the mined material is picked up by pickup scoops 11, which is arranged at the front end of the drilling head 6. The scoops 11, axially rotating with the drilling head 6, take the borings or mined material along and throw it off in the upper area 12 of the mined shaft. Gravity, again, causes the borings or mined material to slide downwardly into chute 13, whereupon the loosened mined material is guided into the pneumatic or hydraulic conveyor installation 14 which removes the material to the earth's surface through a vertical conveyor pipe 15.

The drilling head 6, schematically shown in FIG. 1, is conically formed in the rear region of the machine, to thereby allow the mined borings to slide, unhindered, into the chute 13. The chute 13 is laterally arranged with respect to the machine, in order to take advantage of the natural sliding angle resulting from the conical shape of the driling head and the inclined orientation of the head 6 with respect to the shaft.

Another type of mined material or borings removal mechanism is shown in FIG. 2. The shaft drilling machine 1, similarly designed to the frame construction corresponding to the shaft drilling machine of FIG. 1, is also movable in this second embodiment, in the direction of the longitudinal axis A of the shaft. The drilling head 6 is again inclined by the angle $\alpha$ relative to the longitudinal axis A of the shaft which results in the inclined or sloping shaft bottom 9. The drilling head 6, itself, is designed as a hollow body, having a stationary inner element 7 which is arranged at the drilling head support. The base 9 supporting the drilling tools, (not illustrated), as well as the scoops 11, rotate around the stationary inner element 7. As described above, with respect to the invention shown in FIG. 1, here, too, the borings or loosened mined materials are picked up in the lower area 10 of the shaft base 9 by scoops 11 and is transported into the upper area 12 of the shaft base. There, the scoops empty the borings through their discharge openings and into the interior of the drilling head 6. From there, the borings are conveyed again, by gravity, to chute 16 and from there into the area of the bucket conveyor 17. The bucket conveyor 17 extends, with its intake side, into a chamber 18 from where the borings are transported upwardly by the bucket conveyor 17.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

We claim:

1. A shaft drilling machine for drilling a vertical shaft of eliptical shape and removing the borings therefrom, comprising:

(a) a machine frame;

(b) a drilling head rotatively driven and secured to said machine frame;

(c) said drilling head having vertically adjusting means for selectively vertically adjusting said drilling head in said vertical shaft;

(d) said drilling head having angular adjusting means for selectively adjusting the angular orientation of said drilling head with respect to the longitudinal axis of said vertical shaft;

(e) the angular orientation of said drilling head, with respect to said longitudinal axis, being in the range of at least 35° to about 50°;

(f) said drilling head having borings pickup means for transporting loosened borings from the relative lower end of said drilling head to the relative upper end of said drilling head when said drilling head is angularly oriented in said shaft;

(g) a vertical conveying mechanism for borings in communication with a portion of said drilling head; and (h) a borings transport means for moving said borings from the relative upper end of said drilling head when said drilling head is angularly oriented in said shaft, to said vertical conveying mechanism said borings transport means, during operation, being at least partially facilitated in operation by the force of gravity.

2. A shaft drilling machine, as claimed in claim 1, wherein:

(a) said borings pickup means is located around the outer periphery of said drilling head.

3. A shaft drilling machine, as claimed in claim 1, wherein:

(a) said vertical conveying mechanism for borings is hydraulically operated; and (b) said borings transport means comprises a stationary chute which is centrally located in said machine frame.

4. A shaft drilling machine, as claimed in claim 1, wherein:

(a) said vertical conveying mechanism for borings is pneumatically operated.

5. A shaft drilling machine, as claimed in claim 1, wherein:

(a) said vertical conveying mechanism for borings is a bucket conveyor;

(b) said drilling head has a stationary central chamber such that said bucket conveyor extends into said stationary central chamber of said drilling head; and (c) said central chamber is in communication with the discharge end of said borings transport means.

* * * * *